US006427837B1

(12) United States Patent
Shields

(10) Patent No.: US 6,427,837 B1
(45) Date of Patent: Aug. 6, 2002

(54) SMALL CARD AND MONEY HOLDER WITH SECURITY MEANS

(76) Inventor: Michael Peter Shields, P.O. Box 91, Mammoth Lakes, CA (US) 93546-0091

( * ) Notice: Subject to any disclaimer, the term of this patent is extended or adjusted under 35 U.S.C. 154(b) by 0 days.

(21) Appl. No.: 09/543,818

(22) Filed: Apr. 6, 2000

(51) Int. Cl.[7] ..... B65D 85/48

(52) U.S. Cl. ..... 206/449; 206/37; 150/147

(58) Field of Search ..... 206/449, 37, 38, 206/39, 39.1, 1.5, 425, 39.6; D11/78.1; 224/252; 150/147–149, 137; 220/324, 326

(56) References Cited

U.S. PATENT DOCUMENTS

| | | | | | |
|---|---|---|---|---|---|
| 501,279 | A | * | 7/1893 | Knight | 206/37 |
| 2,031,773 | A | | 2/1936 | Halperin | |
| 2,483,460 | A | * | 10/1949 | Harris | 206/37 |
| 2,575,030 | A | | 11/1951 | Smallman | |
| 2,824,591 | A | | 2/1958 | Anderson | |
| 3,027,995 | A | * | 4/1962 | Littman | 206/38 |
| 3,302,774 | A | * | 2/1967 | Zalkind | 206/37 |
| 3,804,330 | A | * | 4/1974 | Miller, Jr. et al. | 206/39 |
| 4,450,955 | A | * | 5/1984 | Featherston | 206/39.6 |
| 4,805,680 | A | | 2/1989 | Ueno | |
| 5,020,255 | A | * | 6/1991 | Rodel | 40/654 |
| 5,115,909 | A | | 5/1992 | Hull et al. | |
| 5,520,230 | A | * | 5/1996 | Summer, III | 150/147 |
| D377,416 | S | * | 1/1997 | Aurora | D3/201 |
| 5,718,329 | A | | 2/1998 | Ipplolito et al. | |
| 5,725,098 | A | | 3/1998 | Seifert et al. | |
| 5,740,624 | A | * | 4/1998 | Baseley | 40/649 |
| 5,937,681 | A | * | 8/1999 | Myhr et al. | 70/454 |
| 6,050,014 | A | * | 4/2000 | Ohlson | 40/649 |
| 6,082,422 | A | * | 7/2000 | Kaminski | 150/147 |

* cited by examiner

*Primary Examiner*—Shian Luong

(57) ABSTRACT

The present invention comprises a latchable enclosure for the above small plastic and business cards. The invention also comprises a novel support and carrying means and a novel paper currency attachment.

2 Claims, 9 Drawing Sheets

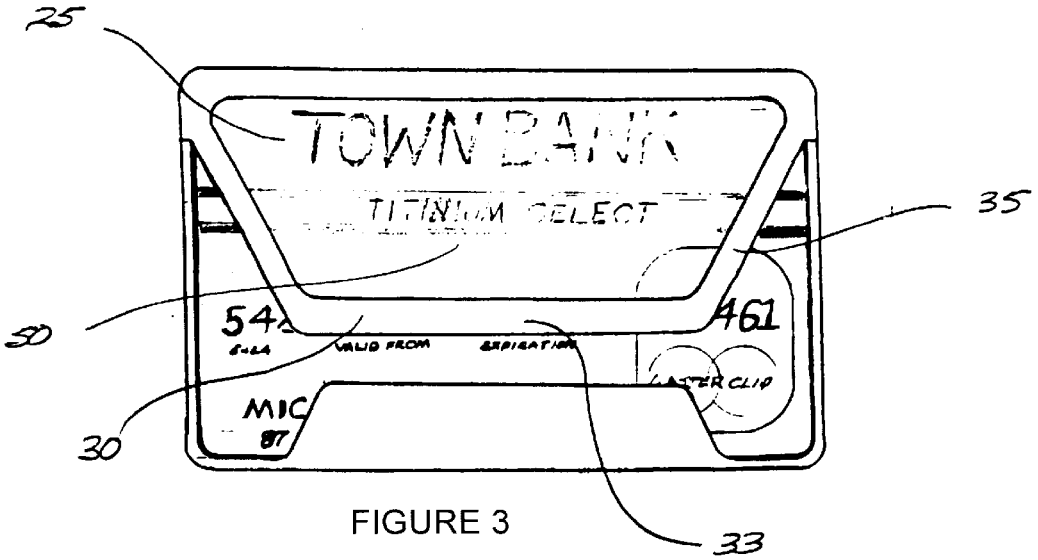
FIGURE 3
FIGURE 4
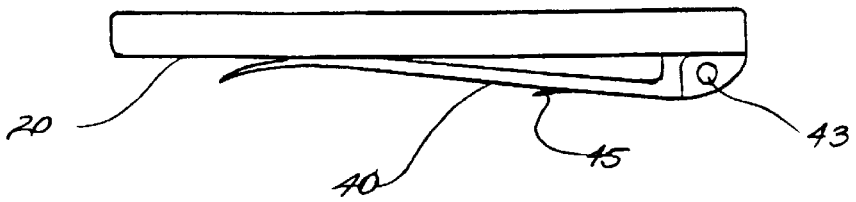
FIGURE 5
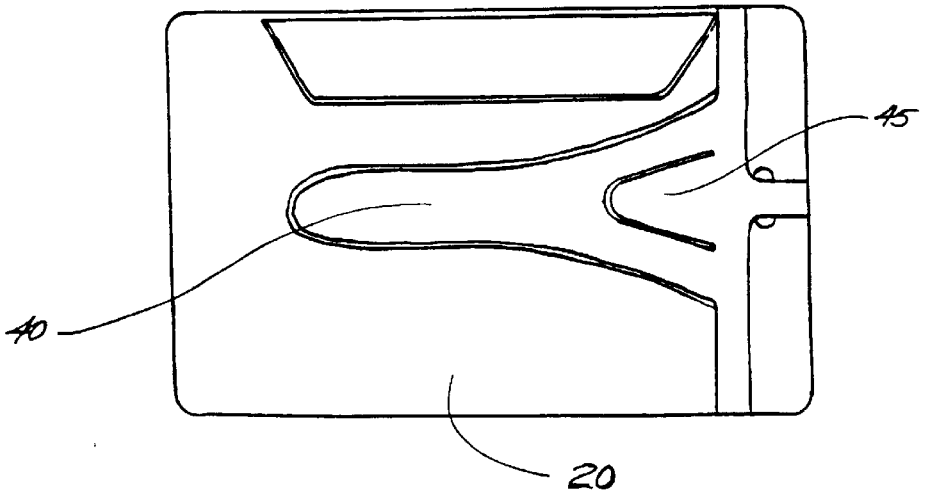

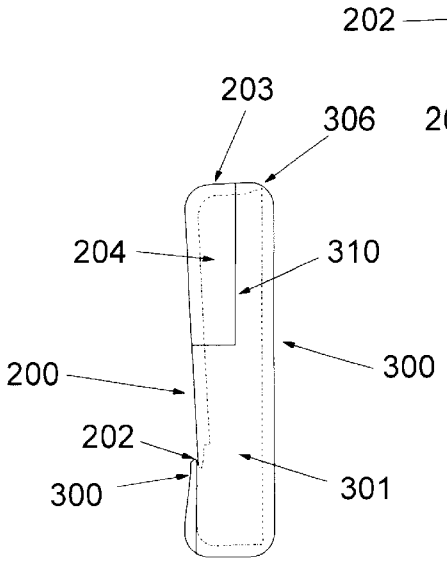
FIGURE 17
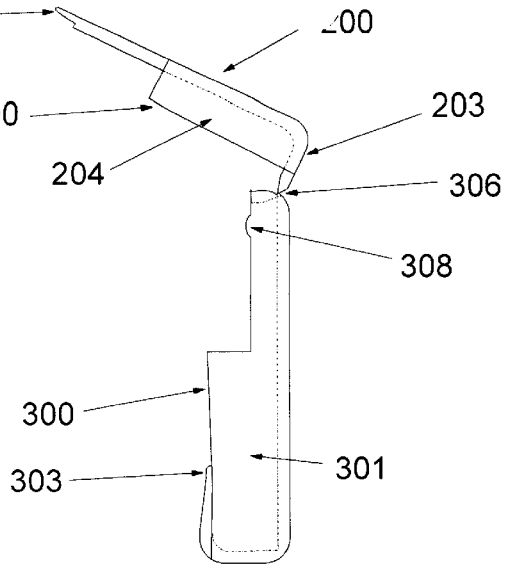
FIGURE 18
FIGURE 19
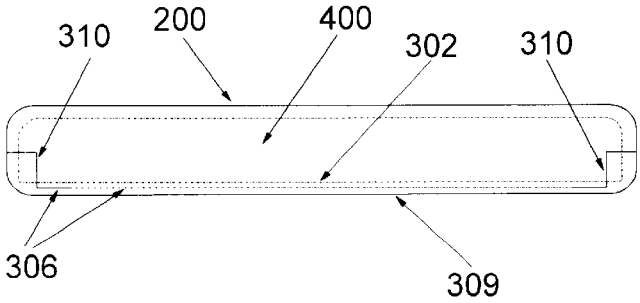
FIGURE 20
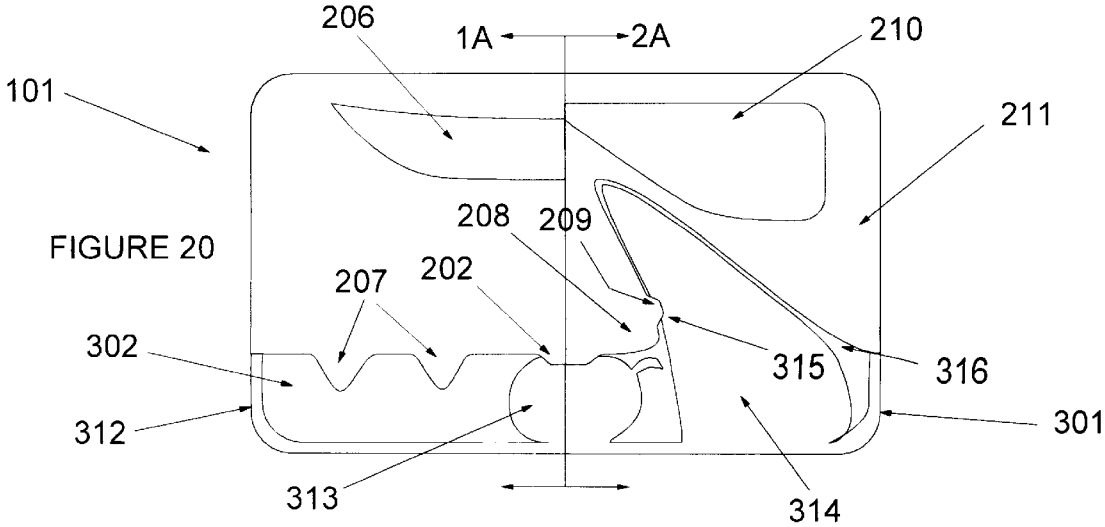

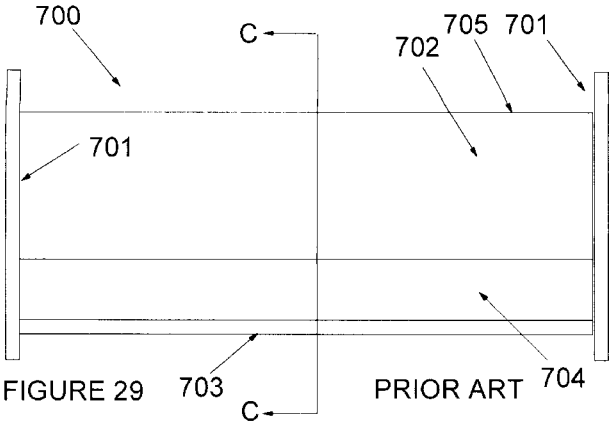
FIGURE 29 PRIOR ART
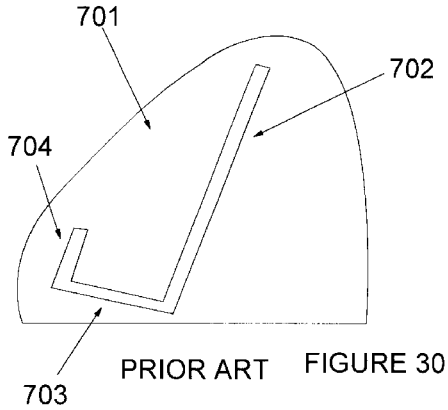
PRIOR ART FIGURE 30
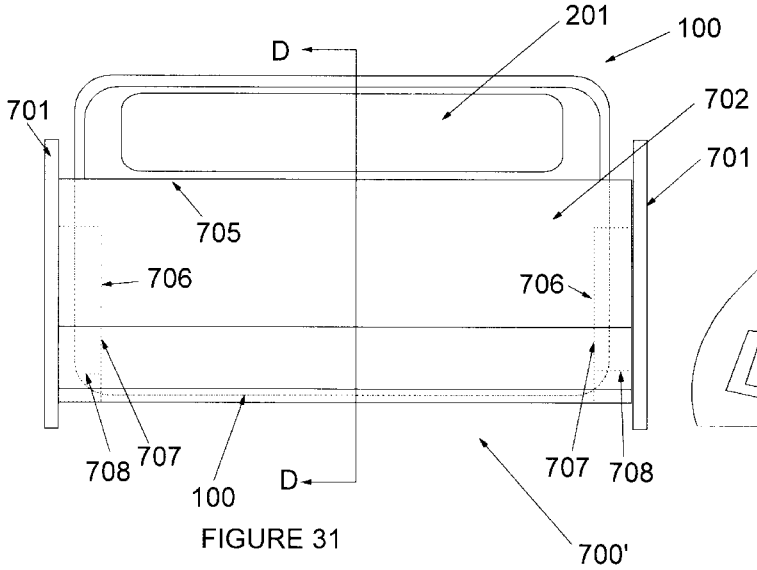
FIGURE 31
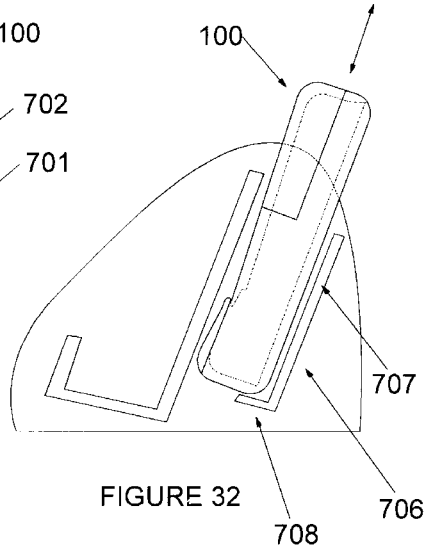
FIGURE 32

SMALL CARD AND MONEY HOLDER WITH SECURITY MEANS

BACKGROUND OF THE INVENTION

The present invention relates to recloseable credit, business and identification card holders.

Plastic cards of about the standard size 3.375"×2.125" include credit and debit cards, "smart cards" as widely used in Europe, identity cards, gift certificates, and other such cards for a variety of uses. Such small sized plastic cards are not only found in potential use for virtually every economic and identification aspect of daily life, but in many cases are the only interface acceptable in such transactions or identification. The verb "swipe" has been transformed from a larcenous definition to a transaction based one. Storing and organizing these cards in a compact and convenient way has been an increasing problem. Many hotels now issue magnetic type key cards to guests when they check in to the hotel. Quite often these key cards become entangled and confused with other items that might be in their pockets such as money, keys, other credit cards, and miscellany. Additionally, there currently seems to be a trend for people to go about their daily activities carrying just a few small plastic cards (such as credit, ATM, and drivers license cards) along with a small amount of money.

The prior art, although related, has been especially directed to devices for the storage of paper money.

U.S. Pat. No. 5,725,098 discloses a portable folding receptacle of wallet format, made from a plastic material and being especially suited as multi-purpose portfolio, it is proposed to connect two half-shells by means of an elastic, integrally formed back hinge comprising longitudinally extending ridges with interposed film-joint hinge elements permitting smooth opening and closing of the receptacle. The receptacle may be equipped with folding inserts, in the manner of a book, or may be equipped in its interior with a ringbook mechanism.

U.S. Pat. No. 5,718,329 discloses a compartment formed from the assembly of a bottom panel, a top panel, a right side panel, a left side panel, and a rear panel. The compartment is suitably sized so as to retain a multiple number of credit cards which are inserted into the compartment through a front opening and which are arranged inside the compartment in a stack and with a same physical orientation. The cards are securely retained inside the compartment by an integrated retention clip, and the cards are extracted from the compartment by means involving an integrated notch. A money clip affixed to the compartment provides a means for the retention of foldable paper currency.

U.S. Pat. No. 5,115,909 discloses a money clip, made from clear extruded plastic, which is adapted to hold not only currency but has a compartment to hold a document such as a driver's license or credit card and may also have a pouch affixed to one of its sides to hold a spare emergency key such as a car door or house key.

U.S. Pat. No. 4,805,680 discloses a card holder with magnifying glass that includes at least one holding part in which cash cards, business cards or so on are put and which is enclosed with sheets. One of the sheets has a lens which is used in order to read small letters on the cards or others.

U.S. Pat. Nos. 2,031,773 and 2824591 disclose "open" case money holders which comprise open edges and have a book cover-like construction.

U.S. Pat. No. 2,575,030 comprises a wallet device with a money holding clip within a hinged closeable holder.

It appears untreated in the prior art to provide some form of security for these devices that hold the object of highest money value to a user. The above devices can easily be forgotten (and often are), may be easily lifted (swiped) from a user's pocket or dropped from the hand of a user to the ground in a sudden collision or in handling several objects at once.

SUMMARY OF THE INVENTION

The present invention comprises a latchable enclosure for the above small plastic and business cards as described above. The invention also comprises novel support and carrying means for paper currency.

BRIEF DESCRIPTION OF THE DRAWINGS

FIG. 3 is a top view of the multi-functional card and money holder showing a credit card in place.

FIG. 4 is a side view of the multi-functional card and money holder.

FIG. 5 is a bottom view of the multi-functional card and money holder

FIGS. 17 and 18 are side end views of the invention holder.

FIG. 19 is a side top view of the invention holder.

FIG. 20 shows a multitude of various embodiments for the cover and back portions to achieve a graphic effect in connection with the functions of the invention holder.

FIGS. 29 and 30 are front and section CC views of a generalized prior business card holder.

FIGS. 31 and 32 are front and section DD views similar to those of FIGS. 28 and 29 wherein are incorporated mounting means for the device of FIG. 10 making the card holder capable of presenting a window highlighted portion of business or other cards therein.

DETAILED DESCRIPTION OF THE INVENTION

Figure 1:
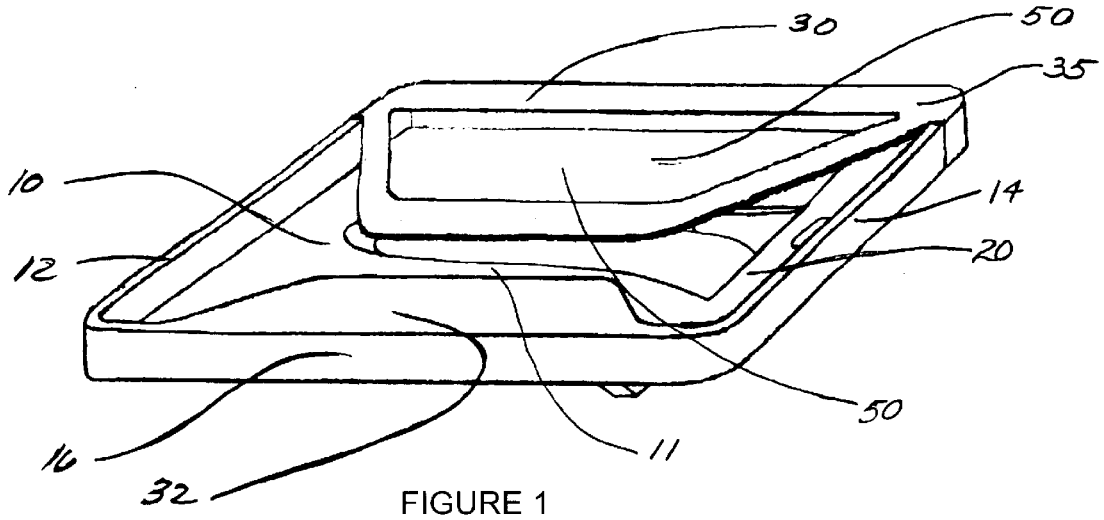
FIG. 1 is a perspective view of the multi-functional card and money holder.

The present invention is now discussed with reference to the Figures.

Referring now to the drawings, FIGS. 1 through 9 show the multi-functional card and money holder invention, number 10. The improved multi-functional card and money holder 10 provides a small, low-profile, compact, lightweight, durable device with functions that include being a versatile money clip, a (credit and other) card holder, magnifier, and key ring/belt loop fob.

The construction of the invention 10 is such that a compartment 11 for the purpose of storing a plurality of credit cards 25 (and the like) is defined from a bottom assembly 20, a top door assembly 30, a top cover assembly 32, a left side panel 12, a right side panel 14, a front panel 16, and rear wall panel 31 that is configured from the top door assembly 30.

Figure 2:
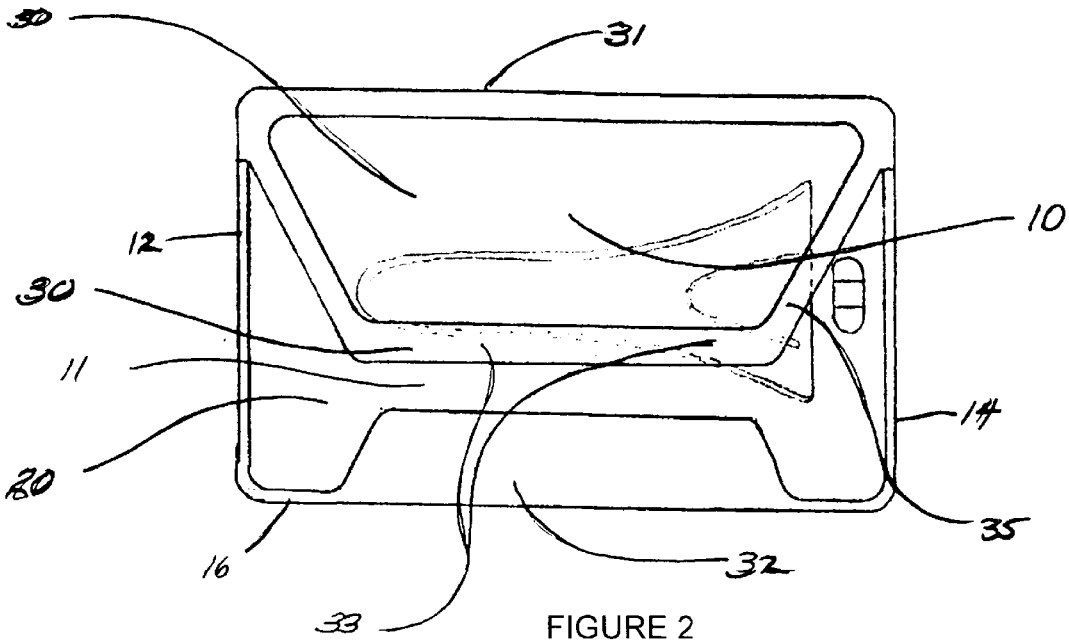
FIG. 2 is a top view of the multi-functional card and money holder.

FIGS. 1 and 2 show the invention in a closed position 35. In FIG. 3 a credit card is shown in place within the invention 10 in the closed position 35.

Figure 6:
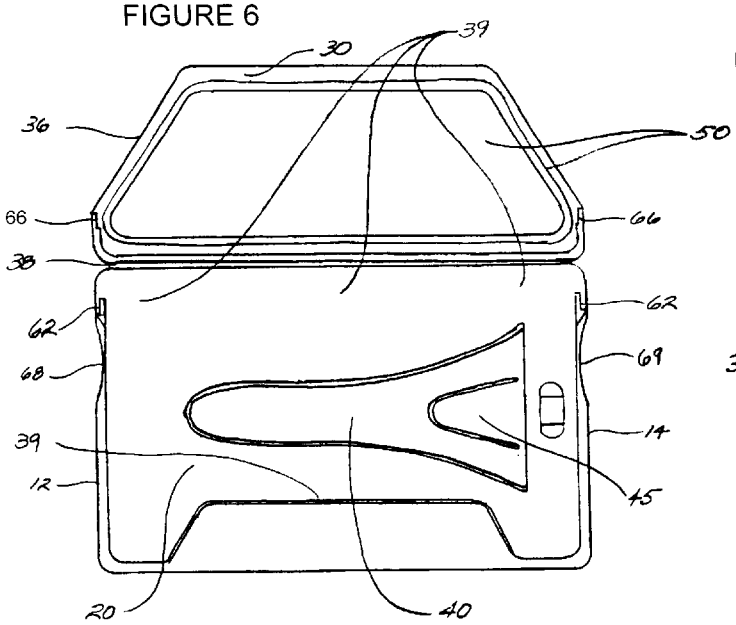
FIG. 6 is a top view of the multi-functional card and money holder with the magnifying lid in the open position.
Figure 10:
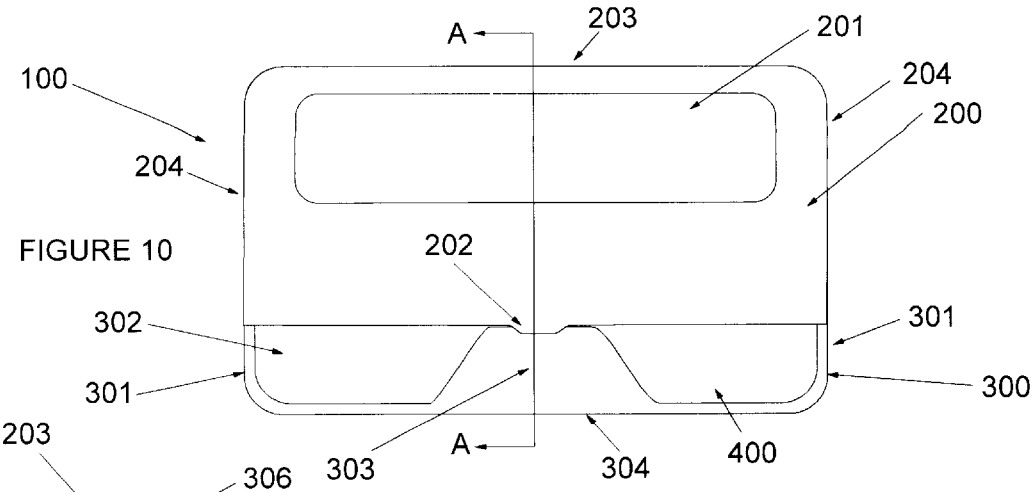
FIG. 10 is a front view of an alternate embodiment of the invention holder.

As seen in FIGS. 3 and 6 the magnifier 50 is configured and affixed (e.g. by insert molding, heat stake, glue, ultrasonic bonding, etc.) to the top door assembly 30. FIG. 3 shows how the magnifier highlights the front (top) credit card 25 yet obscures a large portion of the credit card's number' as a result of the bottom wall 33 of the top door assembly 30. It is noted that the placement of all credit card numbers is universally recognized as illustrated in FIG. 10. It is additionally noted that the bottom portion of the credit card 25 (where typically ones name appears) is partially obscured by the top cover assembly 32. These features help protect confidentially when, for instance, one is doing a cash transaction involving the money clip 40 of the invention 10.

Figure 7:
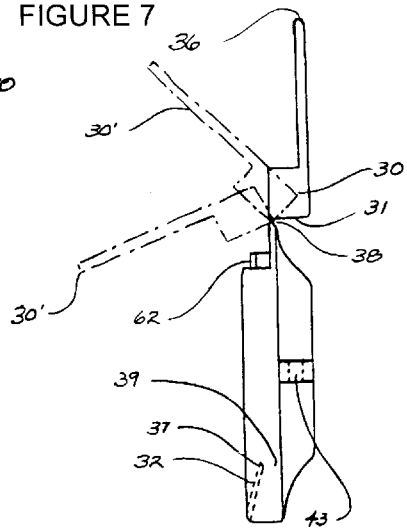
FIG. 7 is a side view of the multi-functional card and money holder with the magnifying lid in the open position.

FIGS. 6 and 7 show the top door assembly 30 in an open position 36. When the top door assembly 30 is rotated open, 30', the rear wall panel 31 of the top door assembly 30 rotates with it about a hinge 38. As the rear wall panel 31 rotates to a completely open position 36, a slot opening 39 results. The user may then remove or insert his card(s) through the slot opening 39. As seen in FIG. 7 the top cover assembly 32 is angled downwardly 37 to provide constant pressure against the cards 25. It is noted that the hinge 38 could be of a living hinge or mechanical hinge design. When the user wishes to close the top door assembly 30 he inserts the card 25 through the slot opening 39 and rotates the top door assembly 30 to the closed position 35 as shown in FIG. 3. A pressure/snap lock results when 66 interfaces with 62 as a result of the top door assembly 30 being folded to the closed position. When this interface occurs and the invention 10 is in a closed position 35 the credit card(s) 25 are securely contained within the compartment 11.

FIG. 6 shows an alliterative embodiment with slight indentations 68 and 69 located in the side panels 12 and l4. By applying inward pressure (squeezing) these indentations 68 and 69 with one's thumb and index fingers (for instance) a slight inward flexure results, thereby releasing the snap lock interface between 66 and 62. When this occurs, the top door assembly 30 rotates upwardly and can then be completely opened.

When the top door assembly 30 is in the open position 36, as illustrated in FIG. 6 and 7 the magnifier 50 is ready for use. The user can then easily adjust the distance and angle of magnification that is best suited for the circumstances required for him to better see the receipt, document, or whatever he is reading.

Figure 8:
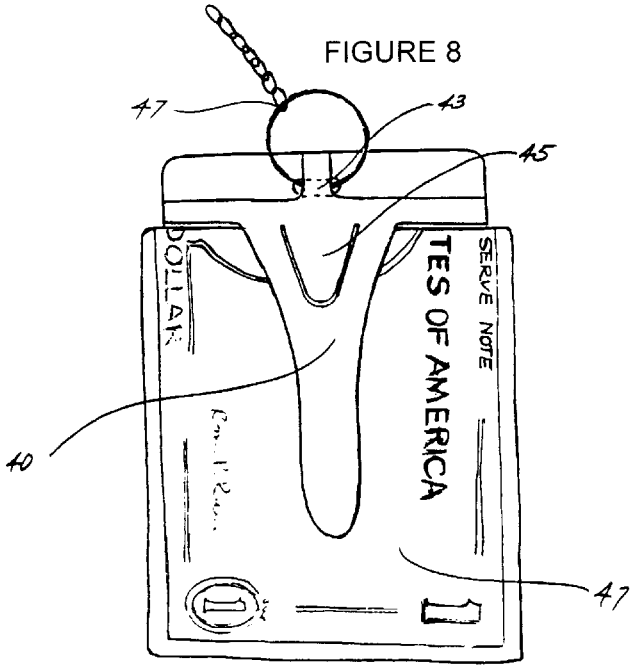
FIG. 8 is a bottom view of the multi-functional card and money holder showing paper currency which has been folded in half being secured by the money clip.
Figure 9:
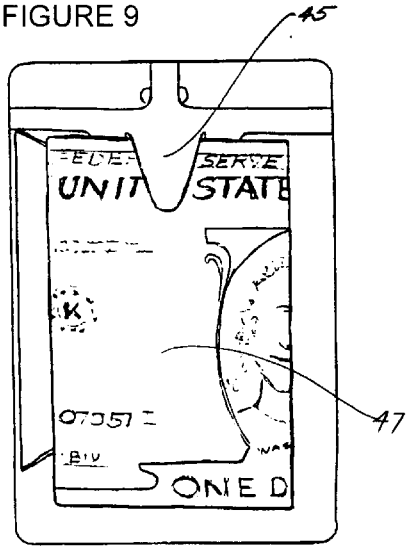
FIG. 9 is a bottom view of the multi-functional card and money holder showing paper currency that has been folded in quarters being doubly secured by the money clip.

FIGS. 4, 5, and 6, show a primary money clip 40 that projects from the bottom assembly 20. A secondary securing clip 45 is configured within the primary money clip 40. The money clips 40 and 45 are designed to hold, accommodate, and secure paper currency 47 in a variety of configurations. FIG. 8 shows paper currency 47 that has been folded in half and inserted vertically between the bottom assembly 20 and the primary money clip 40. FIG. 9 shows paper currency 47 that has been folded in quarters and inserted between the bottom assembly 20, the primary money clip 40 and the secondary securing clip 45. This allows paper currency to be stored and carried in a more compact form while still being firmly attached to the invention 10.

FIG. 8 shows how a key ring/belt fob 47 is attached to the invention 10 through an aperture 43. It is further noted that the user could easily loop a cord, with its ends tied, through aperture 43 and wear the invention 10 around his neck or whereby it may be wound about a belt, loop or other strap appropriately secured directly or indirectly to the wearer's body.

Holder 100 in FIG. 10 comprises a cover portion 200 and a back portion 300. Holder 100 comprises an alternate embodiment of the devices described above. Holder 100 comprises an example of the embodiment herein incorporating a "one-click" opening and closing means. It is intended that the user may place the backside of portion 300 generally in the user's palm so that a top side of portion 202 faces the user as in FIG. 10, whereby the user shall be able to move a thumb of the same hand in the holding palm to depress lateral extension 303 of portion 300 toward floor 302 of portion 300 thereby releasing the "one-click" securement of the portion 200 above floor 302 such that access to the cards inside is provided. Thus, the user shall not be required to use two hands to release the securement of portion 200 over the contents of the cavity 400 of portion 300.

Figure 11:
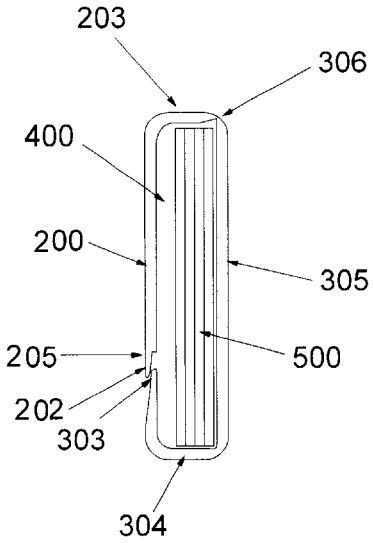
FIGS. 11–16 are various views of the relationship of the cover portion with respect to the back portion as along section AA of FIG. 10.
Figure 12:
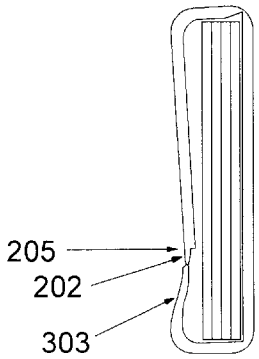
Figure 13:
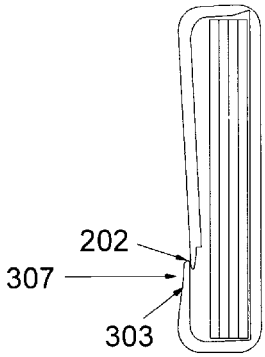

This "one-click" action is demonstrated in FIGS. 11–13. FIG. 11 shows tab 202, which is a lateral extension of the top plate of portion 200, slightly overlaying an overlap section of extension 303 in a released position. Pressure in the direction of arrow 205 will a cause tab 202 to slide over the overlap and force tab 202 past an outer edge of extension 303 as in FIG. 12. Tab 202 will then "one-click" into securement position beneath the previous overlap section. Releasing the securement simply requires similar single hand manipulation and thumb pressure in direction 307 to cause the reverse effect, i.e., tab 202 is forced away from an outer edge of extension 303, as in FIG. 12, such that the released position shown in FIG. 11 is achieved. FIG. 18 shows a preferred embodiment which provides a lug or projection 308 on the edge interface of portion 300 opposing the closure of portion 200 into the closed position, thereby causing the portion 200 to spring open upon positioning tab 202 relative to extension 303 edge as shown in FIG. 12.

Figure 14:
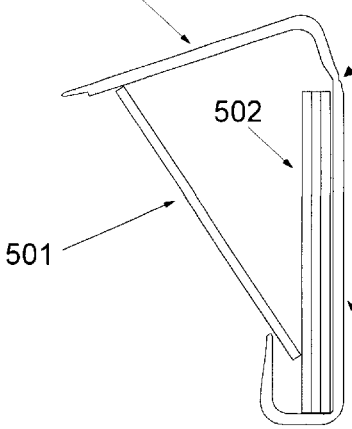
Figure 15:
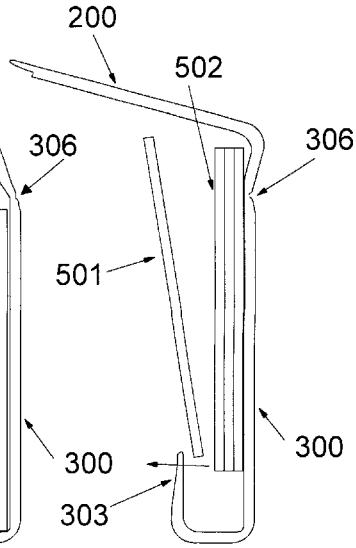
Figure 16:
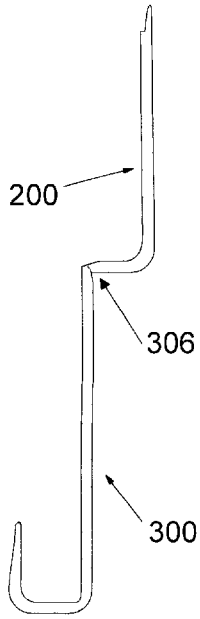

Holder 100 further comprises backwall 203 and sidewalls 204 that extend from the top plate of portion 200 toward the opposing edges of wall 301. Sidewalls are not shown in FIGS. 11–16 for identifying the actions of holder 100 disclosed therein. FIGS. 14–16 disclose critical operational modes of holder 100. FIG. 14 shows how cards 500 of FIGS. 11–13 are removable only by a minimal opening of portion 200 with relation to portion 300 by rotation of a hinge edge of portion 200 about hinge 306. Hinge 306 is shown as a living hinge in this embodiment whereby the entire portions 200 and/or 300 are formed as a single continuously and single shot molded polymer piece generally having hinge 306 extend along the common abutting edges along the backwall 203. FIG. 14 shows portion 200 opened away from portion 300 such that the top plate of portion 200 is moved to a position about 60 degrees outward from its secured or closed position. As shown in FIG. 14, the cooperative structures of portions 200 and 300, especially as to the top plate of portion 200 and extension 303, prevent accidental or intentional removal of card 501 from its secured position within space 400. This relationship clearly distinguishes holder 100 from prior art containers for such cards. Therefore, mere accidental opening of portion 200 from portion 300 cannot create a danger of losing a card 501 or 502 unless the opening is significant and definitely noticeable to the user. As a further benefit of the construction of holder 100 of FIGS. 14–16, cards 502 cannot accidentally slide out of a secure placement at least partly within space 400 as in FIG. 15 unless the minimum angle of FIG. 14 is increased to approximately 130 degrees. FIG. 15 shows that cards 502 sliding directly upward will encounter the obtusely angled inner surface of the top plate of portion 202 and therefore be prevented from spilling from holder 100, while the user may freely remove a single card 501. FIG. 16 shows that the portion 200 may be rotated about hinge 306 to an extreme open position. It is understood that although the advantage of the living hinge shown in FIGS. 11–16 are of particular advantage in creating a single shot embodiment of the invention, a wide range of hinging means will accomplish the same function albeit at a greater cost and inconvenience for assembly and aesthetic appreciation of the smooth and handsome overall design.

FIGS. 17 and 18 show holder 100 of FIG. 10 in side edge view showing a similar operational modes as those of FIGS. 14–16. As shown in FIG. 17, a tightly connected interface seam is formed by the opposing edges of portions 200 and 300 in a secured or closed position. FIG. 19 is a back edge view of holder 100 of FIG. 10, showing the continuation of the interface seam 310 shown in FIG. 17, ending in the ends of hinge 306. The back 309 of portion 300 is generally flat, although as in the above embodiments, provision for cutouts are appropriate for mold and tool making for a single shot piece embodiment or otherwise as may be known in the art with this disclosure.

FIG. 10 discloses an optional although preferable window section 201. As shown in FIG. 10, section 201 comprises a generally rectangular opening that may be without any material, filled with transparent material, tinted or clear, or may be filled with alternate preferred material such as Fresnel lens material of polymer which provides a minimal level of magnification of the materials thereunder. The form of section 201 provides a unique opportunity for embodiments of the present invention. FIG. 20 shows just two of the embodiments which may arise meeting the function of those alternate embodiments. Sections 1A and 2A are intended to be entirely separate forms of the alternate embodiments. Mouth type section 206 is shown to be a curved section approximating a smiling mouth as may be used for promotional item by companies wanting to give the impression that they have happy customers, whereby other appropriate surfaces of the exterior or interior of holder 100 shall provide an indication of the offering of goods or services such as by title, logo, phrase, company name or otherwise so that the user makes such a commercial or favorable association. Section 206 could be appropriate for a promotional item for a dentist having a credit card therein for such services. As another example of relating the shape of section 201 to a commercial or favorable impression in embodiment 2A, sunglass section 210 is one half of representation of a "cool" pair of sunglasses or ski goggles, whereupon the surfaces of holder 100 are imprinted or the surfaces otherwise indicate a connection with a business or organization for a commercial or favorable impression. A printable portion of the top plate is a preferable place for imprinted matter.

More specifically with relation to FIG. 20, the form or the top plate of portion 200 and extension 303 may be changed to represent or enhance the association with the business or organization for a holder 100. Embodiment 1A shows an extension of the lower edge of the top plate of portion 200 in the form of teeth or fangs or EKG waves, thereby providing creative and fanciful association with such businesses respectively such as dentists, Halloween costuming or health services. In embodiment 2A, cutout 316 is made (which may be partially or completely filled with extension 314 of portion 300) such that a nose section 209 is formed leading the user to enhance an association with the sunglass section 210 in top plate 211. Tab 209 may be formed in another location at an interfacing overlap with an extension of portion 300 (shown as overlap with extension 314) whereby the "one-click" tab is formed in a different location than that of FIG. 10. Thus, the "one-click" embodiment of holder 100 of FIG. 10 is shown to be enabled for many locations or orientations in the top or front plane of holder 100.

FIG. 20 shows another promotional aspect of the present invention. Extension 313 is formed in the outline of an apple, bringing to mind products such as Apple® computers, apple or fruit growers or sellers, or other such commercial or favorable associations in the mind of a user. The above describe associations are extremely valuable in commercial or non-profit enterprises. It is intended that the present invention comprise a method for advertising or forming a favorable association with a business or non-profit enterprise by use of the embodiments of FIG. 20.

Figure 21:
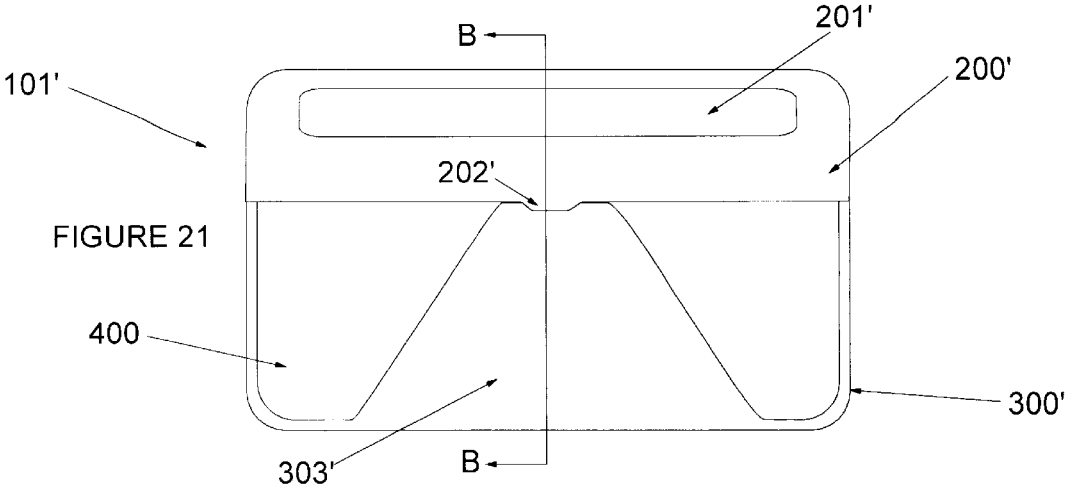
FIG. 21 is an alternate embodiment of the device shown in FIG. 10.
Figure 22:
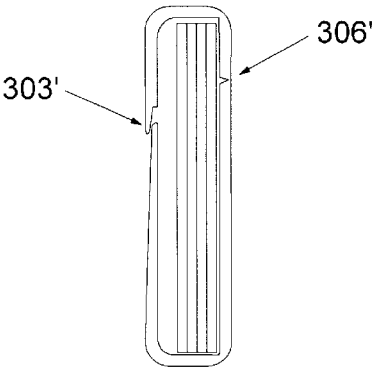
FIGS. 22 and 23 are cross section BB views of FIG. 21 wherein are shown cover positions for an alternate hinge position.
Figure 23:
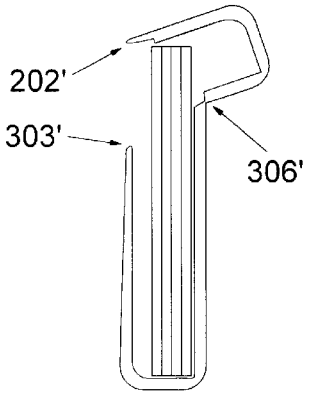
Figure 24:
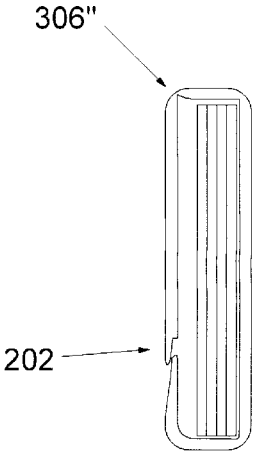
FIGS. 24 and 25 are similar to FIG. 11 in cross section where an alternate hinge position is shown for that device, extending the range therefore as in FIGS. 22 and 23.
Figure 25:
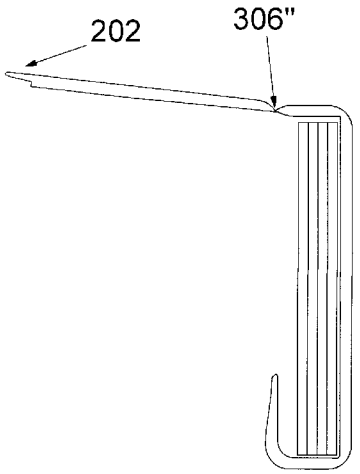

FIGS. 21–23 show two alternate embodiments of the invention. Holder 100' comprises top portion 200' with a top plate reduced in protective surface area, whereby back portion 300' comprises an enlarged extension 303' to form and overlap with tab 202'. In addition, hinge 306' is moved from the box edge for holder 100 to a position on the back of holder 101'. FIGS. 22 and 23 show that the invention function may be achieved with this configuration. A further embodiment of hinge location is shown in FIG. 24, where the hinge location is along a longitudinal edge similar to holder 100, but the hinge 306" location is along a top plate edge, found with reference to holder 100. Thus, for holders 100 and 100' the hinge location is parallel with the longitudinal edges of the device whereby such a hinge may be effectively located in a continuous range from a longitudinal line along the back of holder 100 about 25% down from the top and back longitudinal edge as in FIGS. 23 and 24 to a position shown as hinge 306" in FIGS. 24 and 25.

Figure 26:
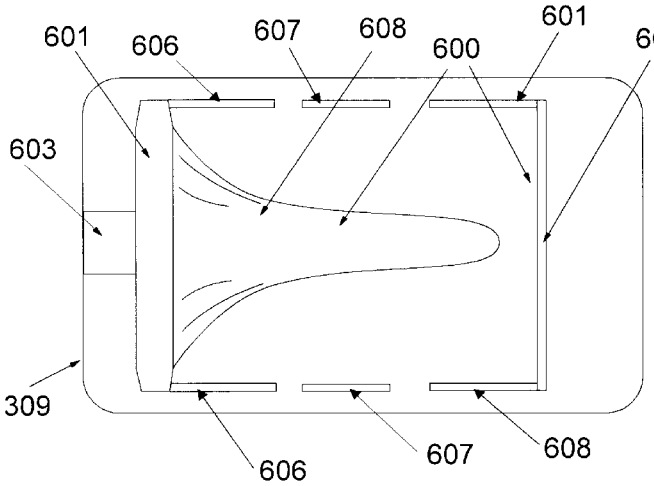
FIGS. 26–28 show respectively top, side and end view of a money clip and attachment loop mounted to the back of the back portion of a device as in FIG. 10.
Figure 28:
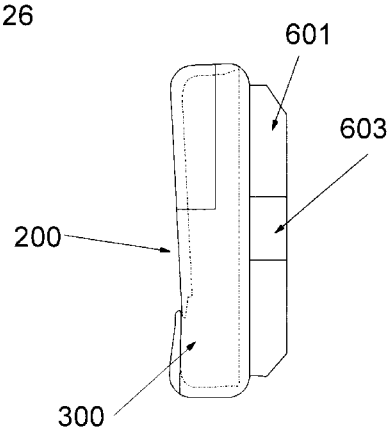
Figure 27:
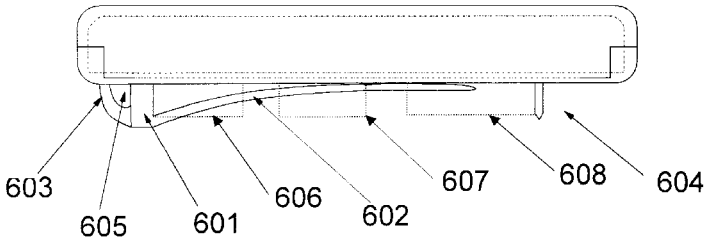

As shown in FIG. 26–28 and as described above, a money clip 600 may be attached to the back 309 of holder 100.

Attaching portion 601 supports a flange 602 adapted to extend from the top of portion 601 to the outside surface of back 309. Attaching portion 601 also supports a loop 603 adapted to extend from the top of portion 601 to the outside surface of back 309 and is adapted to support the weight of holder 100 with a support chain, rope or other rigid or flexible means to some other object such as around a user's neck or attached to the user's clothing or purse. This aspect of security is unknown in money clip and card holding devices. It is intended that other loop locations and structures are broadly preferable to accomplish such security. A molded extension of portions 200 or 300 having an equivalent hole will accomplish such a function. A raised barrier 604 is a substantial improvement over prior art money clips, i.e., the bills placed between flange 602 and back 309 may sometimes easily and accidentally slide from secure placement on normal abrasive movement with clothing and other articles. Barrier 604 prevents such loss from movement in the longitudinal direction.

FIGS. 29 and 30 show a front and cross section CC of a generalized business card holder 700. Ends 701 support a holding portion comprising a back 702, base 703 and front 704. FIGS. 31 and 32 show a front and cross section DD of an invention adaptation of the generalized business card holder 700. On an available surface on ends, a pair of supports 706 having a back 707 and base 708 are provided such that they, in combination with back 702, form a mounting means for holder 100. When holder 100 is used for holding business cards, section 205 may conveniently be mounted to be held in display above a top edge 705 of back 702, thereby to provide a location for storage and display of the business cards of holder 100 as seen in FIGS. 31 and 32. Such a pair of supports 706 or a continuous joined such supports with an opposing top plate surface (as in the backside of back 702) may be conveniently mounted on many locations such as in purses, walls, desk or computer monitor vertical sides or other such vertical or substantially vertically inclined surfaces. Its presentation permits the user to place holder 100 in an easily viewed an secure place when it is not carried by the user.

Figure 33:
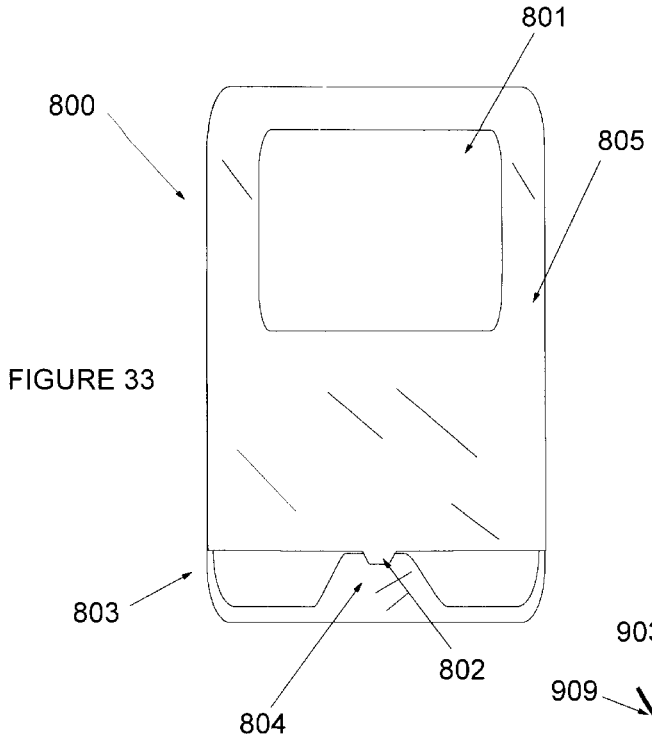
FIG. 33 is an alternate embodiment of the invention holder for small cards, wherein the top plate is arranged to open on a hinge set parallel to a width instead of a length of the holder.

FIG. 33 is an important alternate embodiment of the invention. Holder 800 is analogous to holder 100 in that the longitudinal opening of a top portion 200 relative to a back portion 300 is changed to a lateral opening of an analogously functioning top portion 805 with respect to an analogously functioning back portion 803, whereby holder 800 comprises a holding space for cards enclosed by portions 805 and 803 capable of being secured in a closed position with a "one-click" action via the cooperation of tab 802 and extension 804. Thus, the invention holder is not limited to only a longitudinal embodiment.

Figure 34:
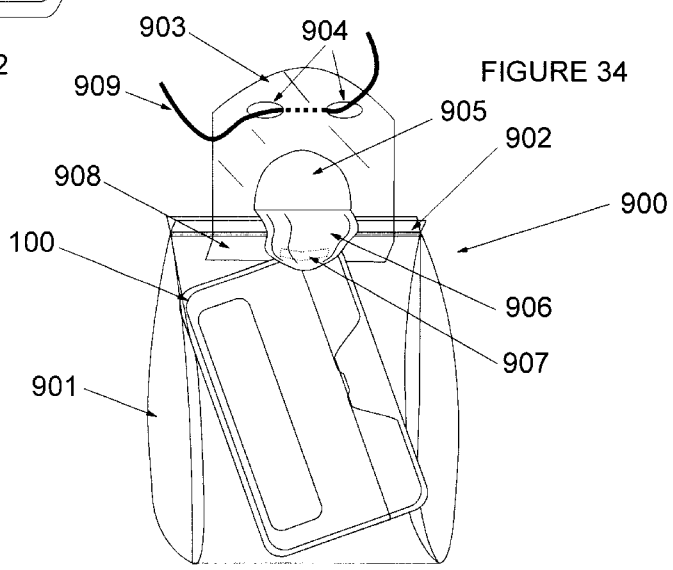
FIG. 34 is a front view of an multiple enclosing means bag for carrying the invention holder.

FIG. 34 discloses a novel carrying bag 900 for holder 100. Bag 900 comprises a preferably at least partially clear flexible polymer bag 901 with a front and back side, the top edges 902 comprising resealable zipper-type means as are well known for food storage bags. To the top and back side of polymer bag 901 is adhesively attached a lower section 908 of a loop attachment 903. Attachment 903 is a generally sturdy plastic sheet of about more than 0.030 mils having formed therein holes for effective supportive threading therethrough lanyard or rope 909 (the connecting ends of which are not shown). Thus, a user may carry holder 100 in a watertight enclosure or may alternately merely carry holder 100 in bag 900 without such closure. As additional protection for such carrying without watertight sealing of edges 902, a flap 906 is cut from the sheet material leaving hole 905, whereupon the distal front side flap edge is adhesively attached light adhesive strip 907 which is securely adhered to flap 906 and on a side facing the polymer bag 901, strip 907 comprises a light adhesive which is tacky and easily adhered and lifted from adhesion with polymer bag 901. Thus, the user need not use the zipper type closure integral with edges 902 where liquid tight closure is not desired. Flap 906 is more easily opened and closed than the more tedious task of causing a polymer zipper type closure to be sealed. Strip 907 also comprises Velcro®, snap fit or snaps, or other such easily re-securable means.

Figure 35:
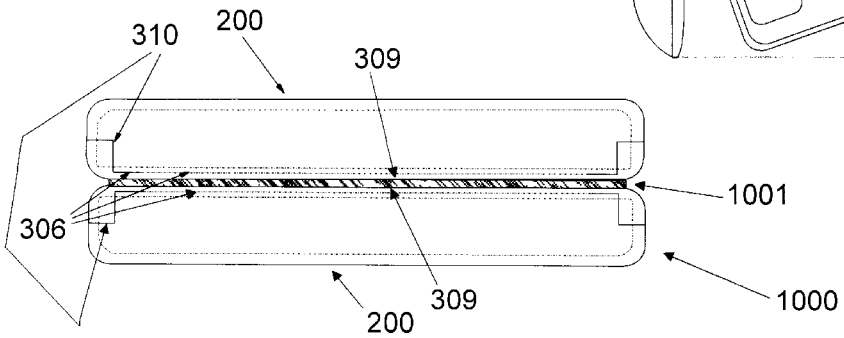
FIG. 35 is a hinge side edge view of two invention holders adhered in a back to back such that two compartments for securely carrying small cards are formed integral with respect to each other.

FIG. 35 shows a back to back embodiment 1000 of the present invention. Two holders as in FIGS. 10–19 are attached at their backs 309 by adhesive material 1001. The resulting integral device comprises two separate and secure spaces for holding small cards, for such uses as giving and receiving business cards.

The above design disclosures present the skilled- person with considerable and wide ranges from which to choose appropriate obvious modifications for the above examples. However, the objects of the present invention will still be obtained by the skilled person applying such design disclosures in an appropriate manner.

I claim:

1. A substantially rectangular box holder for small cards whose hinged structure has been formed as a single continuously molded piece to define a cavity in a closed position and with a depth, height and length comprising:

(a) a cover portion adapted to permit user access to the holder cavity by rotation about a living hinge continuously molded to join at least part of a lengthwise edge of a top edge plate of the cover portion and at least a part of a lengthwise edge of a back portion, such that an other lengthwise edge of the top edge plate is joined to a top plate, the distance from one lengthwise edge of the top edge plate to the other lengthwise edge is at least some portion of the depth of the holder, and the top plate in a closed position securely covers contents of the holder cavity;

(b) the back portion comprises a rectangular floor having a length equal to the holder length and side walls extending to a distance equal to the holder depth from a non-hinge lengthwise edge and the two adjacent other edges of the floor such that the hinge joins the top edge plate along a remaining lengthwise edge of the back portion;

(c) the hinge axis is located at a lengthwise position from a backside of the holder in the plane of the floor to a lengthwise position in the plane of the top edge plate when in the closed position;

(d) the back portion further comprises at least one extension from the side wall distal to the hinge, the extension extending to overlie at least a portion of floor not overlain by the top plate in the closed position and whereby the extension lies in about the same plane as the top plate in the closed position; and (e) in the closed position a tab of the top plate overlaps a relatively small portion of the extension from the side wall such that depression of the top plate locates the tab below the small portion of the extension from the side wall.

2. The holder of claim 1 wherein a latching means is provided for releaseably latching the cover portion to the back portion.

* * * * *